US005179417A

United States Patent [19]

Sugaya et al.

[11] Patent Number: 5,179,417

[45] Date of Patent: Jan. 12, 1993

[54] APPARATUS FOR PRINTING ON OPPOSITE SURFACES OF A STRIP OF PRINTING PAPER

[75] Inventors: Tomio Sugaya; Yasuyuki Tsuji; Yasuo Kikuchi; Katsuhiro Akinaga; Masaaki Akutsu; Motoji Kurobane, all of Ibaraki, Japan

[73] Assignee: Hitachi Koki Co., Ltd., Tokyo, Japan

[21] Appl. No.: 868,418

[22] Filed: Apr. 15, 1992

[30] Foreign Application Priority Data

Apr. 22, 1991 [JP] Japan ..... 3-90140

[51] Int. Cl.[5] ..... G03G 15/00

[52] U.S. Cl. ..... 355/319; 355/24; 355/274

[58] Field of Search ..... 355/319, 23, 24, 318, 355/308, 271, 274, 310, 210; 101/DIG. 37; 226/197; 346/160; 358/300

[56] References Cited

U.S. PATENT DOCUMENTS

| | | | |
|---|---|---|---|
| 3,548,783 | 12/1970 | Knapp | 226/197 X |
| 3,580,670 | 5/1971 | Bhagat | 355/23 X |
| 3,940,210 | 2/1976 | Donohue . | |
| 4,306,800 | 12/1981 | Kopp . | |
| 4,392,738 | 7/1983 | Fujino et al. . | |
| 4,410,897 | 10/1983 | Moriguchi et al. | 355/23 X |
| 4,427,285 | 1/1984 | Stange | 355/24 X |
| 4,843,429 | 6/1989 | Avritt | 355/317 X |
| 4,929,982 | 5/1990 | Ainoya et al. | 355/310 X |
| 4,958,187 | 9/1990 | Tsuchiya | 355/319 X |

*Primary Examiner*—Richard L. Moses

*Attorney, Agent, or Firm*—Sughrue, Mion, Zinn, Macpeak & Seas

[57] ABSTRACT

An apparatus for printing on opposite surfaces of a strip of printing paper using two electrophotographic printing units wherein each printing operation is of high quality and thermal damage to the printing is minimized. The apparatus includes a first electrophotographic printing unit for printing on the front surface of the printing paper, a buffer unit for temporarily holding the printing paper discharged outside of the first electrophotographic printing unit, a turn unit for turning over the printing paper, and a second electrophotographic printing unit for printing the reverse surface of the printing paper. A toner having a low melting temperature is employed for each of the first and second electrophotographic printing units so that developing treatment is conducted only with the aid of a heat roll but without any use of a preheating plate. A back-up roll adapted to cooperate with the heat roll is coated with a tetrafluoroethylene-based synthetic resin. The second electrophotographic printing unit is provided with a paper presser for squeezing the printing paper against a photosensitive drum only within the printing width range. A retract mechanism is operatively connected to the paper presser.

9 Claims, 2 Drawing Sheets

APPARATUS FOR PRINTING ON OPPOSITE SURFACES OF A STRIP OF PRINTING PAPER

BACKGROUND OF THE INVENTION

The present invention relates to an apparatus for printing on opposite surfaces of a strip of printing paper using two electrophotographic printing units each adapted to operate using a light beam, e.g., a laser light beam, wherein a high quality printing operation is performed on each of the opposite surfaces of the printing paper.

To facilitate understanding of the present invention, a conventional electrophotographic printing unit adapted to operate using a laser light beam will be described briefly below with reference to FIG. 4. The conventional electrophotographic printing unit includes a charger 1, a photosensitive drum 2, a light beam 3 (e.g., a laser light beam), a developing portion 4, a first tractor 5 for continuously conveying a strip of printing paper, a second tractor 6 for continuously conveying the printing paper, a strip of printing paper 7 having a series of perforations formed along opposite sides thereof, a preheating plate 11 (heated to a temperature of about 100° C.) for fixing developed toner images, a heat roll 12 (heated to a temperature of about 100° C.) for fixing the toner images, a back-up roll 13 for squeezing the printing paper 7 against the heat roll 12, a pair of puller rollers 14 for pulling the printing paper 7, a stacker 15 for receiving the printing paper 7 discharged from the puller rollers 14, an image transferring portion 17 for transferring the developed toner images onto the printing paper 7, a lower retractor 19, an upper retractor 20, and a retractor spring 21.

With the conventional electrophotographic printing unit constructed as described above, while the photosensitive drum 2 is electrically charged by the charger 1 while receiving a laser light beam 3 emitted in the arrow-marked direction as shown in FIG. 4, each character written on the photosensitive drum 2 in the form of a latent image by the laser light beam 3 is developed by the developing portion 4. Subsequently, as a strip of printing paper 7 is delivered from the first tractor 5 and conveyed to the second tractor 6 via the retractor spring 21, the lower retractor 19, and the upper retractor 20, the developed toner images (i.e., the developed toner characters) on the photosensitive drum 2 are transferred onto the printing paper 7 with the aid of the transferring portion 17.

To assure that the developed toner images are uniformly transferred onto the whole surface of the printing paper 7, the latter is spaced away from the photosensitive drum 2 a predetermined distance (0.5 mm or less) with the aid of the lower and the upper retractor 19, 20. After the printing paper 7 is conveyed further by the second tractor 6, it is sufficiently heated by the preheated plate 11 and then passed between the heat roll 12 and the back-up roll 13, causing the developed toner images to be fixed onto the printing paper 7. Once the fixing operation is completed, the printing paper 7 is received in the stacker 15 with the aid of the puller rollers 14.

However, it is anticipated that, on the assumption that two substantially similar electrophotographic printing units constructed in the above-described manner are used for printing operations, malfunctions will arise which will undesirably degrade the quality of the printing operation. This occurs especially when printing on the reverse surface of the printing paper by the second electrophotographic printing unit after the paper is turned over from the front surface upon completing of the printing operation in the first electrophotographic printing unit.

More specifically, when the developed toner images are fixed onto the printing paper with the aid of a preheating plate and a heat roll in the first electrophotographic printing unit, the printing paper is thermally damaged to a certain extent, causing it to be warped due to local expansion and contraction of the printed paper. This results in the flatness of the printing paper being degraded by a quantity ranging from 0.5 to 1.0 mm. In addition, when the developed toner images are transferred onto the printing paper from a photosensitive drum of the second electrophotographic printing unit, a portion of the developed toner images will probably be incorrectly transferred onto the printing paper due to the fact that because of the aforementioned warpage of the printing paper, it is practically difficult to properly hold the printing paper away from the photosensitive drum in the spaced relationship with a predetermined distance kept therebetween. In other words, a portion of the developed toner images representing certain characters is not printed on the printing paper.

Additionally, since the toner images fixed in the first electrophotographic printing unit come in contact with a preheating plate and a back-up roll in the second electrophotographic printing unit, the fixed toner will probably become molten by the preheating plate with the result that the molten toner is parted away from one surface of the printed paper or it oozes onto the opposite surface of the paper. Thus, a portion of the printed images is not visually recognized. Further, there may arise another problem wherein the surfaces of the preheating plate and the back-up roll are undesirably contaminated with the molten toner.

SUMMARY OF THE INVENTION

Accordingly, it is a general object of the present invention to provide an apparatus for printing on opposite surfaces of a strip of printing paper using two electrophotographic printing units which is free of the above-mentioned problems and disadvantages.

It is also an object of the present invention to provide an apparatus for printing on opposite surfaces of a strip of printing paper using two electrophotographic printing units, each having the same feeding speed, wherein the printing operation is performed with minimal thermal damage to the printing paper.

It is another object of the present invention to provide an apparatus for printing on opposite surfaces of a strip of printing paper using two electrophotographic printing units, each having the same feeding speed, wherein image transference to the printing paper is satisfactorily accomplished even though one surface of the printing paper is undesirably warped when developed toner images are thermally fixed thereto.

In accordance with the above and other objects, the present invention provides an apparatus for printing on opposite surfaces of a strip of printing paper using two electrophotographic printing units, each having the same feeding speed, the printing paper having a series of perforations formed along opposite sides thereof for the purpose of feeding the printing paper, wherein the apparatus includes a first electrophotographic printing unit for printing the front surface of the printing paper, a buffer unit for temporarily holding the printing paper discharged outside of the first electrophotographic printing unit, a turn unit for turning over the front surface of the printing paper so as to allow the reverse surface of the same to appear as a working surface, and a second electrophotographic printing unit for printing the reverse surface of the grinding paper discharged from the turn unit.

To assure that developing treatment is conducted with a lower thermal load without using a preheating plate, it is preferred that a toner having a low melting temperature be employed for each of the first and second electrophotographic printing units. The toner is fixed onto the printing paper only with the aid of a heat roll adapted to cooperate with a back-up roll, whereby thermal damage to the printing paper is minimized.

The back-up roll in the second electrophotographic printing unit adapted to come in contact with the toner which has been fixed onto the printing paper in the first electrophotographic printing paper is preferably molded of silicone rubber having excellent releasability of which surface is coated with a film of tetrafluoroethylene-based synthetic resin.

To squeeze the printing paper against a photosensitive drum in the second electrophotographic printing unit, a paper presser is operatively secured to a retractor which normally serves to hold the printing paper away from the photosensitive drum a predetermined distance.

The paper presser is divided into two parts as shown from the transverse direction viewpoint, one of the two parts being such that it serves to squeeze the printing paper against the photosensitive drum only within the printing width range and other one being such that it serves to hold the printing paper away from the photosensitive drum within the non-printing width range. A retract mechanism is operative for each of the two parts of the paper presser to hold the paper presser at an inoperative location.

In contrast to the conventional electrophotographic printing unit as described above with reference to FIG. 4, since each of the first and second electrophotographic printing units is not equipped with a preheating plate, the printing paper will not become contaminated with molten toner after completing the first printing operation or the molten toner will not ooze on the opposite surface of the printing paper, which will result in character data being lost.

Other objects, features, and advantages of the present invention will become apparent from reading the following description of the preferred embodiment which has been made in conjunction with the accompanying drawings.

BRIEF DESCRIPTION OF THE DRAWINGS

The present invention is illustrated in the following drawings in which.

DESCRIPTION OF THE PREFERRED EMBODIMENT

The present invention will be described in detail hereinafter with reference to the accompanying drawings which illustrate a preferred embodiment of the present invention.

Figure 4:
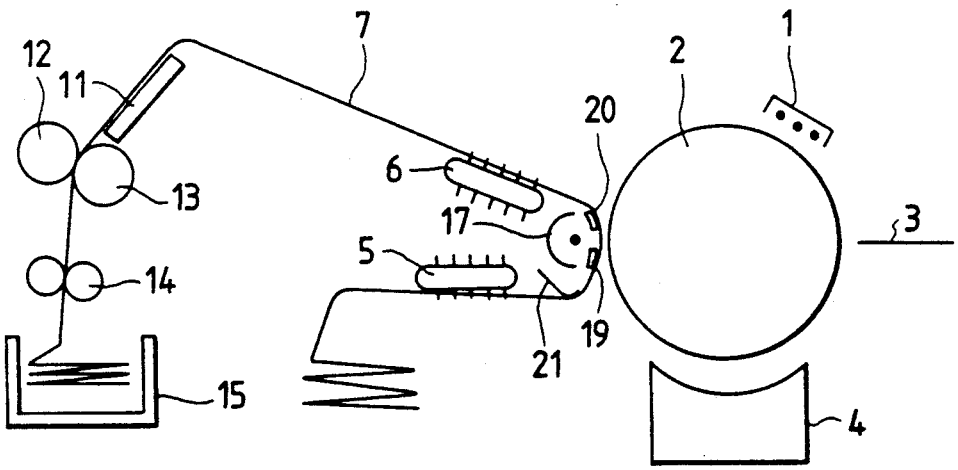
FIG. 4 is a schematic side view of a conventional electrophotographic printing unit adapted to operate using a laser light beam, particularly illustrating the whole structure of the unit.

It should be noted that an electrophotographic printing unit adapted to operate using a laser light beam with a substantially similar structure as that of the conventional one described above with reference to FIG. 4 is employed for an apparatus for printing on opposite surfaces of a strip of printing paper in accordance with the present invention. The same components of the embodiment of the present invention to those of the conventional electrophotographic printing unit are represented by the same reference numerals. Thus, description of the same components will not be repeated.

Figure 1:
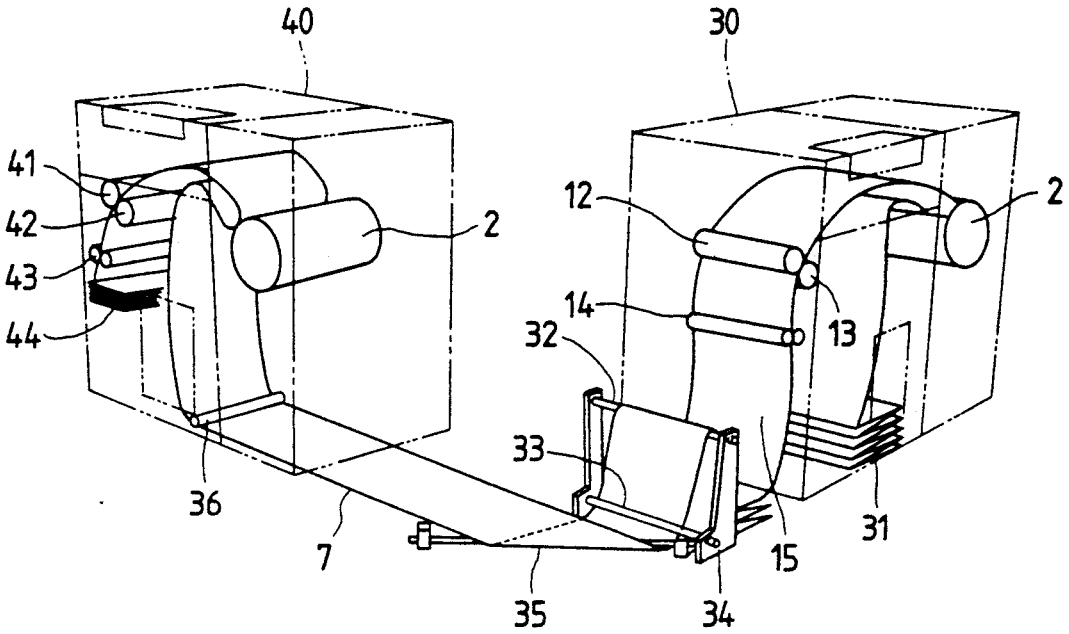
FIG. 1 is a schematic perspective view of an apparatus for printing on opposite surfaces of a strip of printing paper using two electrophotographic printing units in accordance with an embodiment of the present invention, particularly illustrating the whole structure of the apparatus.

First, an order of conveyance of a strip of printing paper will be described below with reference to FIGS. 1 to 3. A first electrophotographic printing unit 30 includes a paper hopper 31 from which a strip of printing paper 7 is discharged with the aid of a first tractor 5. Subsequently, the printing paper 7 is conveyed to a second tractor 6 via a retractor 21, a lower retractor 19 and an upper retractor 20. At this time, developed toner images on a photosensitive drum 2 are transferred onto the printing paper 7 with the aid of a transferring portion 17.

Subsequently, as the printing paper 7 is conveyed further by a second tractor 6, it passes between a heat roll 12 and a back-up roll 13, causing the toner images on the printing paper 7 to be fixed onto the printing paper 7. After completion of the fixing operation, the printing paper 7 is received in a stacker 15. Here it should be noted that a preheating plate is not used for the first electrophotographic printing unit 30 in contrast with the conventional electrophotographic printing unit as described above with reference to FIG. 4. The same is true with respect to the second electrophotographic printing unit 40 which is described later.

Next, when a shaft switch (not shown) is actuated by an operator, the stacker 15 does not exhibit its own stacking function, causing the printing paper 7 to be discharged outside of the first electrophotographic printing unit 30 without any folding operation. Then, the printing paper 7 passes through a paper buffer portion 34 constructed of an upper bar 32 and a lower bar 33 to reach a turn portion 35 in which the printing paper 7 is turned over upside down. In other words, the unprinted reverse surface of the printing paper 7 is prepared in the turn portion 35 to serve as a working surface. Thereafter, the printing paper 7 is delivered to a turn bar 36 arranged in a paper hopper portion of a second electrophotographic printing unit 40 which is identical to the structure of the first electrophotographic printing unit 30.

It should be noted that the paper feeding speed of the second electrophotographic printing unit 30 is equal to that of the first electrophotographic printing unit 30. The reverse surface of the printing paper 7 is now ready for the start of the next printing operation under a condition that the timing relationship of start and stop of operation of the first electrophotographic printing unit 30 is properly controlled by a controller (not shown). An order of flow of the printing paper 7 in the second electrophotographic printing unit 40 is substantially the same to that of the first electrophotographic printing unit 30 with the exception that after completion of a fixing operation, with the aid of a heat roll 41 and a back-up roll 42, the printing paper 7 is received directly in a stacker 44 by a pair of puller rollers 43.

To accomplish the step of printing in the first and second electrophotographic printing units 30 and 40, a toner having a low melting temperature (about 100° C.) is used such that electrically charged toner images are developed on a photosensitive drum 2 and, after transference of the developed toner images onto one surface of the printing paper 7, the images are fixed onto the printing paper 7 under the influence of pressure and with the aid of a heat roll 12, 41 and a backup roll 13, 42. Each of the heat rolls 12 and 41 are constructed of an al tube coated with a film of tetrafluoroethylenebased synthetic resin and a halogen lamp (not shown) incorporated in the aluminum tube. In addition, each of the back-up rolls 13 and 42 is constructed of a heat resistant silicone rubber of which surface is coated with a film of tetrafluoroethylene-based silicone synthetic resin having excellent releasability (e.g., PFA, PEP).

The operating conditions employed for a fixing operation performed in each of the first and second electrophotographic printing units 30 and 40 are such that the working surface of each guide (not shown) arranged for properly guiding movement of the printing paper 7 in each of the electrophotographic printing units is not undesirably contaminated with molten toner. Moreover, the printing paper 7 exhibits an excellently high fixing strength enough to prevent the toner from being parted from the printing paper 7, and an excessive quantity of toner is not fixed onto the printing paper 7 without thermal damage resulting.

Figure 2:
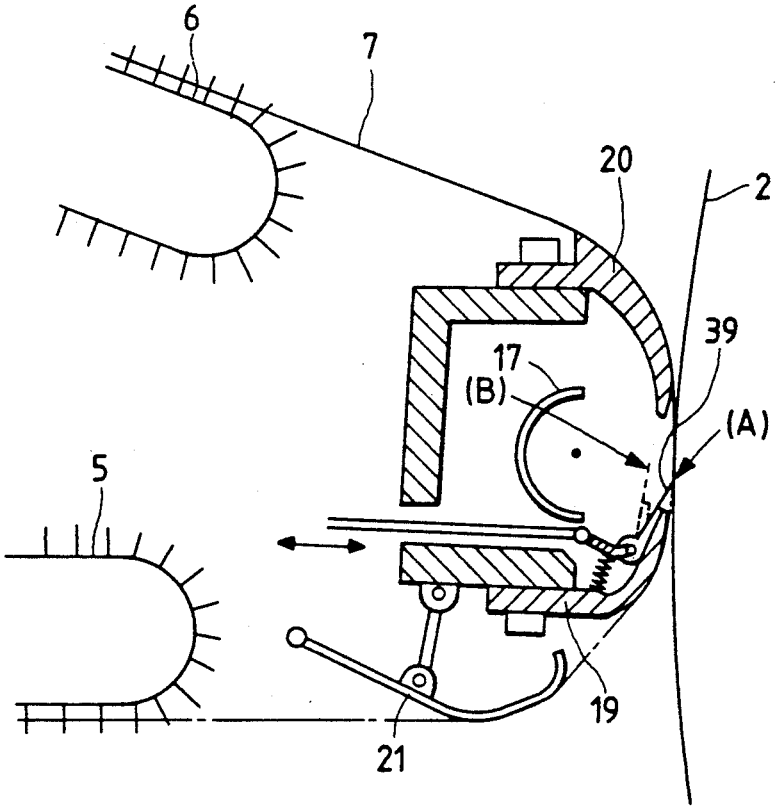
FIG. 2 is a fragmentary vertical sectional view of the apparatus shown in FIG. 1, particularly illustrating an image transferring section.
Figure 3:
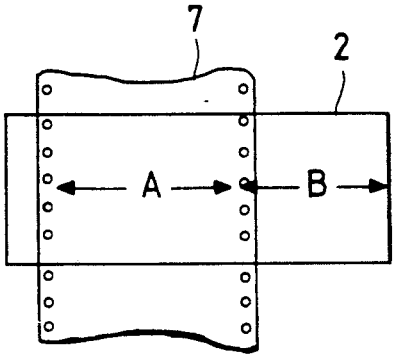
FIG. 3 is a fragmentary front view of the image transferring section shown in FIG. 2.

Referring to FIG. 2, the second electrophotographic printing unit 40 includes a paper presser 39 which serves to squeeze the printing paper 7 against the photosensitive drum 2 when developed toner images are transferred onto the reverse surface of the printing paper 7 in which the opposite surface (i.e., front surface) having already been printed with the toner transferred from the photosensitive drum 2. It should be added that the paper presser 39 is operatively secured to the foremost end part of the lower retractor 19 which normally serves to hold the printing paper 7 in the spaced relationship relative to the photosensitive drum 2 with a predetermined distance kept therebetween. The paper presser 39 is made of a plate-shaped material having high elasticity and excellent wear resistance (e.g., a plate molded of a polymide resin while having a thickness of 0.2 to 0.3 mm). As shown in FIG. 3, the paper presser 39 is constructed such that it is divided into two parts as shown from the transverse direction viewpoint in the drawing, one of them serving to squeeze the printing paper 7 against the photosensitive drum 2 only within the printing width range A and other one being displaced away from the photosensitive drum 2 by a retract mechanism (not shown) within the non-printing width range B to prevent the photosensitive drum from being injured or scratched thereby. It should be added that each of the two divided parts of the paper presser 39 is equipped with a retracting mechanism (not shown) to hold the printing paper 7 at an inoperative location. Specifically, the paper presser 39 squeezes the printing paper 7 against the photosensitive drum 2 from the back side only during a printing operation but it is moved away from the photosensitive drum 2 together with the lower retractor 19 when no printing operation is being performed.

According to the present invention, with the apparatus constructed in the above-described manner, developed toner images are thermally fixed onto the printing paper 7 only with the aid of the heat roll 12 in cooperation with the back up roll 13 without the use of a preheating plate in the first electrophotographic printing unit, minimizing the thermal damage to the printing paper 7. Thus, flatness of the printing paper 7 can consistently be maintained.

Similarly, developed toner images are thermally fixed onto the printing paper 7 only with the aid of the heat roll 41 in cooperation with the back-up roll 42 but without the use of a preheating plate in the second electrophotographic printing unit 40. Thus, the toner, which has been fixed on the printing paper 7 in the first electrophotographic printing unit 30, is not molten and not parted away from one surface of the printing paper 7, nor does the toner ooze on the opposite surface of the paper, resulting in the loss of certain character data.

In the second electrophotographic printing unit 40, the printing paper 7 is squeezed against the photosensitive drum 2 by the paper presser 39, causing the printing paper 7 to be brought in contact with the photosensitive drum 2. Consequently, the developed toner images can be uniformly transferred onto the whole surface of the printing paper 7, as shown from the transverse direction viewpoint, not only on the front surface side but also on the reverse surface side of the printing paper 7.

In addition, since a back-up roll molded of a silicone rubber, of which surface is coated with a film of tetrafluroethylene-based synthetic resin having excellent releasability, is employed for each electrophotographic printing unit to cooperate with the heat roll, the surface of the back-up roll does not become contaminated with molten toner, especially when the toner, which has been fixed on the printing paper 7 in the first electrophotographic printing unit 30, is molten because of heat generated by the heat roll 41 in the second electrophotographic printing unit 40.

In sum, the apparatus of the present invention offers the following advantageous effects:

(1) Since thermal damage given to a printing paper is minimized and the printing paper is forcibly brought in contact with a photosensitive drum by a paper presser in the second electrophotographic printing unit, developed toner images can be uniformly transferred onto the printing paper when performing the printing operation for the reverse surface of the printing paper in the second electrophotograhic printing unit, resulting in a high quality printing operation.

(2) Since the need for a preheating plate is eliminated and a material employable for the back-up roll is improved the second electrophotographic printing unit does not become undesirably contaminated with molten toner. As a result, the number of manhours required to maintain the apparatus, such as a cleaning operation, is reduced remarkably.

While the present invention has been described above with respect to a single preferred embodiment thereof, it should of course be understood that the present invention should not be limited only to this embodiment but various changes or modifications may be made without departure from the scope of the invention as defined by the appended claims.

For example, while a tractor feed has been described, it is apparent that frictional drive systems for the paper may be used. Such are well known in the paper handling art.

What is claimed is:

1. An apparatus for printing on opposite surfaces of a strip of paper using two electrophotographic printing units, comprising:

means for feeding said paper;

a first electrophotographic printing unit for printing on a front surface of said printing paper;

a buffer unit for temporarily holding said printing paper discharged outside of said first electrophotographic printing unit;

a turn unit for turning over said printing paper so as to prepare a reverse surface thereof as a working surface; and a second electrophotographic printing unit for printing on said reverse surface of said printing paper discharged from said turn unit.

2. The apparatus as claimed in claim 1, wherein said first electrophotographic printing unit has a paper feeding speed equal to a paper feeding speed of said second electrophotographic printing unit.

3. The apparatus as claimed in claim 1, further comprising a controller wherein a timing relationship start and stop operation of each of said first and second electrophotographic units is controlled.

4. The apparatus as claimed in claim 1, wherein said buffer unit comprises an upper bar and a lower bar.

5. The apparatus as claimed in claim 1, wherein developing treatment is conducted using a toner having a low melting temperature in each of said first and second electrophotographic printing units and said toner is fixed onto the printing paper only with the aid of a heat roll and a back-up roll to minimize thermal damage to said printing paper.

6. The apparatus as claimed in claim 5, wherein said backup roll in each of said first and second electrophotographic printing unit adapted to come in contact with said toner which has been fixed onto said printing paper in said first electrophotographic printing unit is molded of a silicone rubber of which surface is coated with a film of tetrafluoroethylenebased synthetic resin having excellent releasability.

7. The apparatus as claimed in claim 1, wherein said second electrophotographic printing unit is provided with a paper presser for squeezing the printing paper against a photosensitive drum, said paper presser being operatively secured to a retractor which holds said printing paper away from said photosensitive drum with a predetermined distance kept therebetween.

8. The apparatus as claimed in claim 7, wherein said paper presser is divided into two parts, one of said two parts squeezes said printing paper against said photosensitive drum only within the printing width range and the other one of said two parts holds said printing paper away from said photosensitive drum within the non-printing width range.

9. The apparatus as claimed in claim 8, wherein each of said two parts of said paper presser includes a retract mechanism.

* * * * *